United States Patent [19]

Kinosz et al.

[11] 4,165,263

[45] Aug. 21, 1979

[54] METHOD OF PREPARING AN ELECTROLYTIC CELL FOR OPERATION

[75] Inventors: Donald L. Kinosz, Palestine, Tex.; Charles E. Jennings, Maryville, Tenn.; Stanley C. Jacobs, Lower Burrell, Pa.

[73] Assignee: Aluminum Company of America, Pittsburgh, Pa.

[21] Appl. No.: 947,847

[22] Filed: Oct. 2, 1978

[51] Int. Cl.[2] ..... C25C 3/06; C25C 3/08

[52] U.S. Cl. ..... 204/67; 204/243 R

[58] Field of Search ..... 204/64 R, 67, 243 R

[56] References Cited

U.S. PATENT DOCUMENTS 3,822,195 7/1974 Dell et al. ..... 204/64 R 4,110,178 8/1978 La Camera et al. ..... 204/64 R

*Primary Examiner*—T. M. Tufariello

*Attorney, Agent, or Firm*—David J. Hill

[57] ABSTRACT

A method is disclosed for preparing for operation a cell, having an outer shell and an inner lining, which is employed to produce metal by electrolysis of a compound of the metal in a molten production bath. The method includes placing in the cell an initial bath having a solidus temperature higher than the solidus temperature of the production bath, and higher than the temperature maintained on the inside surface of the shell. Because of this higher solidus temperature, a freeze-line barrier for the initial bath is established within the lining of the cell. Subsequently, electrolysis is carried out in the production bath.

5 Claims, 2 Drawing Figures

PRIOR ART

METHOD OF PREPARING AN ELECTROLYTIC CELL FOR OPERATION

BACKGROUND OF THE INVENTION

This invention is related to the production of metal by electrolysis in a molten bath. More particularly, the invention involves a method of preparing a cell for efficient operation in the electrolytic production of metal so that current losses and corrosion damage in the cell are reduced during such operation.

One method of operating a metal producing electrolysis cell to which the invention may be applied is described in U.S. Pat. No. 3,822,195 of Dell et al. This method operates to produce metal from the electrolytic reduction of the metal chloride dissolved in a molten solvent by electrolyzing the chloride-solvent bath in a cell which includes an anode, at least one intermediate bipolar electrode and a cathode. These cell elements are arranged in a superimposed, spaced relationship defining inter-electrode spaces between the anode and the uppermost electrode, between each pair of intermediate electrodes, and between the lowermost electrode and the cathode. In the practice of the method of Dell et al., electrolysis of the chloride-solvent bath takes place in each inter-electrode space to produce chlorine on each anode surface thereof and metal on each cathode surface thereof. The method also includes the establishment and maintenance of a flow of bath through each inter-electrode space to remove the metal produced from each such space. The bath flow is directed into, across and out of each inter-electrode space by utilization of the chlorine produced as the lifting gas in a gas lift pump which lifts the lighter bath upwardly while permitting heavier molten metal swept from each inter-electrode space to settle in a sump in the bottom of the cell.

The cell of Dell et al. includes an outer shell of steel which is lined with refractory brick made of thermally insulating, electrically nonconductive material. In the bottom of the cell is a graphite lined refractory sump for collecting the metal produced, and in the upper zone of the cell is a bath reservoir.

As series of improvements to the cell of Dell et al. is described in U.S. Pat. No. 4,110,178 of LaCamera et al. These improvements include the provision of an outer cooling jacket surrounding the shell of the cell, and the addition to the shell of an inner corrosion resistant, electrically insulating barrier portion. The shell of LaCamera et al. thus includes a steel portion having a coating of plastic or rubber material on the inside surface thereof and a layer of glass between this coating and the inside lining of refractory brick. An additional lining of graphite is positioned on the brick side walls alongside and above the anodes of the cell to provide further protection against the corrosive influence of the bath and the chlorine gas produced by the operation of the cell.

The preferred bath that is utilized in the production of metal in these cells is an essentially homogeneous solution comprised of the metal chloride dissolved in a molten solvent of higher decomposition potential. The method of Dell et al. and the cells of Dell et al. and LaCamera et al. are particularly appropriate for use in the production of aluminum. For such production, therefore, the bath composition normally is composed essentially of aluminum chloride dissolved in one or more halides of higher decomposition potential than aluminum chloride. These halides will usually be made up of alkali metal chlorides, although other alkali metal halides and alkaline earth halides may also be employed. A presently preferred composition of this production bath includes an alkali metal chloride base composition made up of about 50–75% by weight sodium chloride and 20–50% by weight lithium chloride. Aluminum chloride is dissolved in such base composition to provide a bath from which aluminum may be produced by electrolysis, and an aluminum chloride content of about 1.5–10% by weight of the bath will generally be desirable.

The relative concentrations of the two major bath constituents, sodium chloride and lithium chloride, exert the greatest influence on the electrical resistance of the production bath. Thus, for example, a higher concentration of sodium chloride results in higher resistance, and a higher concentration of lithium chloride results in lower resistance. As the electrical resistance of the production bath increases, the electrical efficiency of the cell operation decreases. Thus, with higher bath resistance, higher electrical current levels are required to produce a given amount of metal. For this reason, presently preferred production bath compositions include concentrations of sodium chloride at the lower end of the range described above, or in other words, near 50% by weight. As an example, a satisfactory production bath may be composed of 51% by weight sodium chloride, 40% lithium chloride, 6.5% aluminum chloride and 2.5% magnesium chloride. Traces of other chlorides, such as potassium chloride and calcium chloride, may be included as well, although the chlorides other than sodium chloride, lithium chloride and aluminum chloride may be regarded as incidental components or impurities. The production bath is maintained in a molten state, usually at a temperature above the melting point of aluminum, typically at about 700° C.

In addition to the effect on electrical efficiency of the relative concentrations of sodium chloride and lithium chloride in the production bath, it is also known that these relative concentrations affect the solidus temperature, the temperature below which only the solid phase can exist, of substantially all of the bath. A higher concentration of sodium chloride will result in a higher solidus temperature for the bath. Conversely, a higher concentration of lithium chloride in the bath will result in a lower solidus temperature.

It has been found that, during the operation of the cells of Dell et al. or LaCamera et al., the production bath may impregnate the porous graphite linings, as well as the porous refractory linings in the cell. In addition, the bath may seep through the interstices between the refractory bricks, or through cracks in individual bricks that may arise from thermal stresses. Because the molten production bath is a good conductor of electricity, impregnation of the cell linings by the bath may provide an electrical pathway from the anode through the saturated linings to the cathode. The establishment of such a pathway would result in a current flow that would bypass the intermediate bipolar electrodes, and thus would not contribute to the production of metal. Such a current loss reduces the efficiency of cell operation because when it exists, a greater current level must be introduced to the cell to produce a given amount of metal.

In addition, although an electrically insulating, corrosion resistant barrier portion may be provided between the steel portion of the shell of the cell and the refractory linings, occasional failure of this barrier portion may lead to contact between the bath and the steel portion of the shell, thus establishing an electrical pathway of molten bath between the electrically conductive steel portion of the shell and the anode or cathode of the cell. Since the cells of Dell et al. and LaCamera et al. are of the type employing bipolar electrodes, zones of opposite polarity may be established in the steel portion of the shell by contact therewith by the liquid bath. If this happens, localized electrolysis of the bath may occur at these polarized zones in the steel portion of the shell. Such localized electrolysis may impair cell operation by depositing metal at negatively polarized, or cathodic zones in the steel portion. The metal thus deposited on the steel portion may alloy with the steel and thereby weaken the shell. Further characteristic of this localized electrolysis in a bath comprised of a metal chloride dissolved in a molten solvent of higher decomposition potential is the evolution of chlorine at positively polarized, or anodic zones in the steel portion of the shell. Chlorine is highly corrosive to the steel in the shell, and may cause deterioration and even perforation of the shell at sites of chlorine evolution. Perforation of the shell could be particularly disastrous if it led to contact of the bath with a coolant such as water which may be provided in a cooling jacket on the exterior of the shell.

Another problem may arise during the operation of the cells of Dell et al. or LaCamera et al. when these cells are constructed with refractory brick linings containing silica. This problem involves a reaction between the aluminum metal produced in the cells and the silica in the brick. As electrolysis proceeds in these cells, droplets of produced metal may impregnate the porous brick lining. When this occurs, the aluminum metal may react with the silica in the brick to form alumina and silicon. Such a reaction causes rapid deterioration of the structure of the brick, by the removal of silica therefrom.

SUMMARY OF THE INVENTION

It is an object of the present invention to provide a method by which a cell, having an outer shell and an inner lining, which is employed in the production of metal by electrolysis of a compound of the metal dissolved in a molten production bath, may be prepared for operation so as to minimize current losses in the cell during operation. It is a further object of this invention to provide a method for preparing such a cell for operation so as to reduce corrosion damage to the shell of the cell during operation. It is yet another object of this invention to provide a method for preparing a cell for operation so as to reduce deterioration of the cell lining during operation. In accordance with these and other objects, a method for preparing a cell is provided, which method includes placing in the cell an initial bath having a solidus temperature higher than the solidus temperature of the production bath, and higher than the temperature at which the inside surfaces of the shell of the cell are maintained, so that a freeze-line barrier for the initial bath is established within the lining of the cell. After this freeze-line barrier is established, the relative concentrations of the bath constituents are adjusted, so that electrolysis may be carried out more efficiently in the production bath.

In order to facilitate an understanding of the invention, reference is made to the application of the method of the invention illustrated in the accompanying drawings, and detailed descriptive language is employed. It should be understood nevertheless that it is not intended that the invention be limited to the particular application shown. Various changes and alterations are contemplated such as would ordinarily occur to one skilled in the art to which the invention relates.

DETAILED DESCRIPTION OF THE INVENTION

Figure 1:
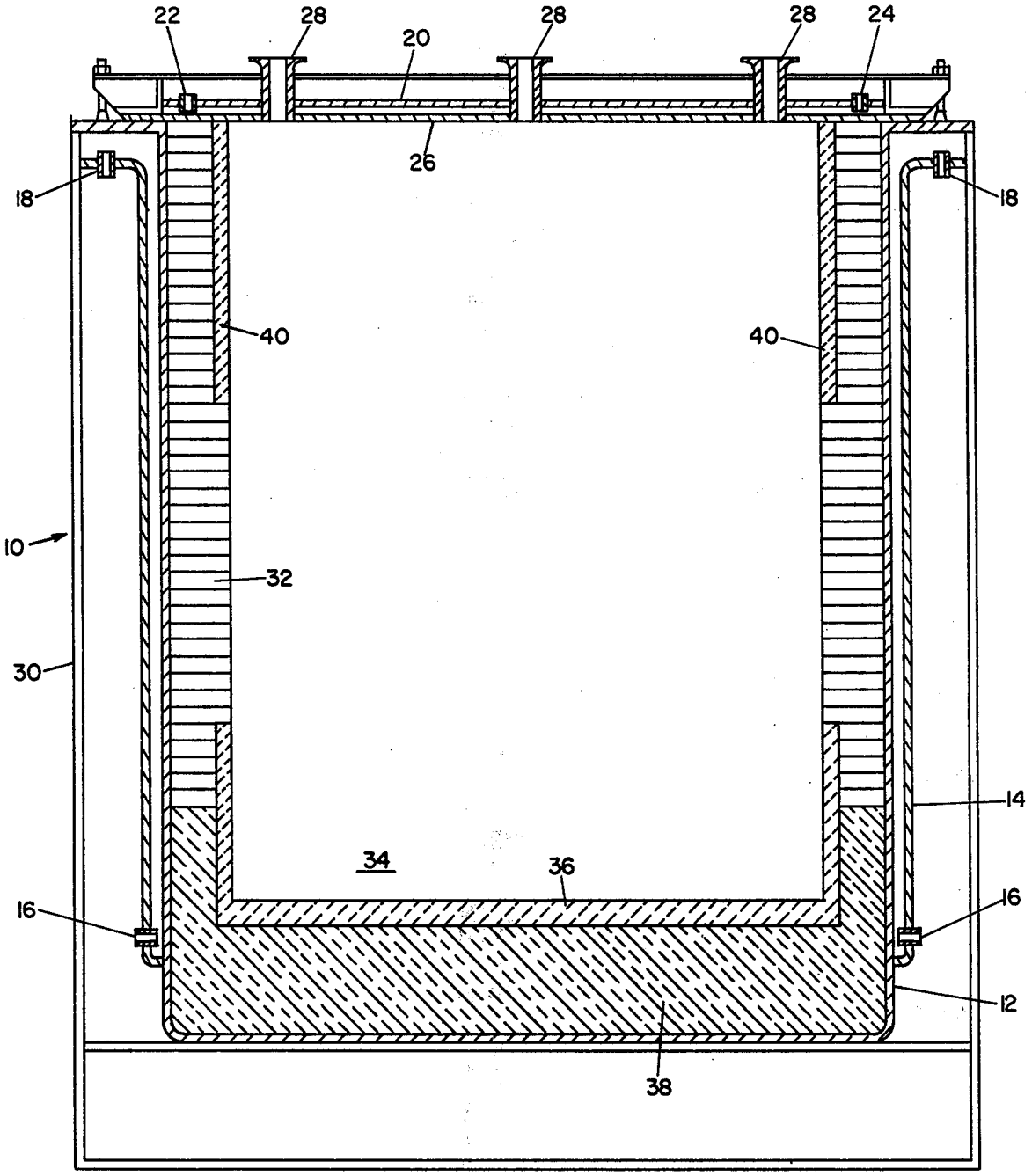
FIG. 1 is a schematic elevational cross section of a cell of the prior art to which the method of the invention may be applied.

The methods of the present invention may be practiced in a cell such as is illustrated in FIG. 1. This cell is identical in basic structure to one of the embodiments of LaCamera et al. However, illustration of the anodes, cathodes, bipolar electrodes and other appurtenances of that cell that are not necessary for an understanding of the present invention has been omitted from FIG. 1.

The cell illustrated in FIG. 1 may be employed to produce metal by electrolysis of a production bath comprised of a compound of the metal dissolved in a molten solvent. The method of this invention may be applied to any cell which is operated to produce metal in such a way. However, the cell of FIG. 1 is particularly appropriate for employment in the production of metal such as aluminum from the electrolytic reduction of a production bath comprising the metal chloride dissolved in a molten solvent. Consequently, the discussion that follows describes this cell and the application thereto of the method of the invention in terms that relate to the production of metal such as aluminum by such a method.

Cell 10 includes shell 12, having an outer steel portion and an inner corrosion resistant, electrically insulating barrier portion (not shown). Shell 12 is bounded on its sides by cooling jacket 14. A coolant such as water flows through jacket 14 during operation of the cell to remove heat therefrom. The coolant enters the cooling jacket at inlet ports 16, and is removed at exit ports 18. A similar cooling jacket 20 with inlet ports 22 (only one of which is shown) and exit ports 24 (only one of which is shown) is provided for cell cover 26. Located in the cover and extending therethrough are accessory ports 28. Such ports may be used for tapping metal from the cell, feeding metal chloride to the cell, venting chlorine gas from the cell, or for inspection, sampling or insertion of monitoring instruments. A structural containment 30 encloses shell 12 and cooling jacket 14, and provides support for the cell.

The cell is lined with an inner refractory brick lining 32. Bounding the sump 34 of the cell, where produced metal is collected, is inner graphite lining 36 and inner refractory sump lining 38. Inner side wall linings 40 of graphite are positioned inside of brick lining 32 alongside and above the location of the anodes. For convenience, linings 32, 36, 38 and 40 are hereinafter referred to collectively as the "inner lining".

As has been pointed out, presently preferred production bath compositions include concentrations of sodium chloride near 50% by weight. It has now been found according to the present invention, however, that more efficient overall cell operation may be effected by placing in the cell before the beginning of electrolysis an initial bath having a higher concentration of sodium chloride, and having a solidus temperature higher than the temperature maintained at the inside surface of the shell of the cell. By preparing the cell for operation in this manner, a freeze-line barrier may be established within the inner lining of the cell. The location of this barrier depends upon the solidus temperature of the initial bath and the temperature gradient that exists through the inner lining, between the shell and the bath.

During electrolytic operation, the cell contains bath at a relatively high temperature, about 700° C. Because the inside surface of shell 12 is maintained at a lower temperature by the presence of cooling jacket 14 (or if the cooling jacket were not present, by contact of the shell with the surrounding ambient air), a temperature gradient exists across the thickness of the inner lining, between shell 12 and the bath at the inner surface of brick liner 32 or of graphite liners 36 and 40. Heat is transferred by conduction from the bath through the inner lining to shell 12, where it is transferred to the coolant circulating in jacket 14. The thermal gradient exists because the materials in the inner lining exhibit resistance to this conductive transfer of heat.

Figure 2:
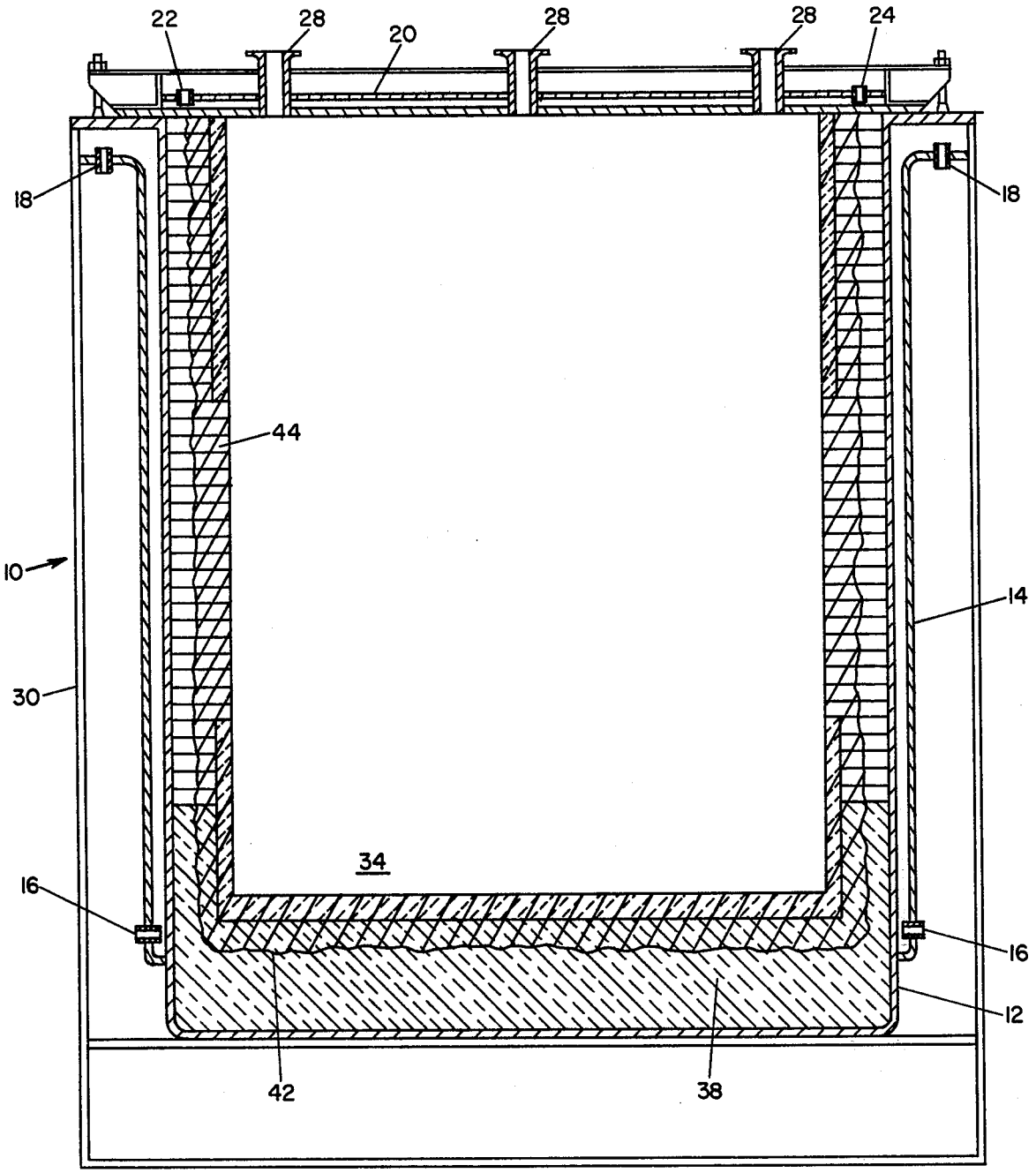
FIG. 2 is a schematic elevational cross section of the cell of FIG. 1 which further illustrates the operation of the invention.

If the solidus temperature of the bath in the cell is higher than the temperature at the inside surface of shell 12, the solidus temperature will be within the range of the temperature gradient that exists between the shell and the bath. Therefore, the temperature at some location within the inner lining of the cell will correspond with the bath solidus temperature. Temperatures at locations in the lining nearer the bath will be higher, and temperatures at locations in the lining nearer the shell will be lower. The particular location in the lining that exhibits a temperature corresponding to the solidus temperature of the particular bath composition in the cell will be the site of a freeze-line barrier to the liquid bath. FIG. 2 illustrates a freeze-line barrier 42 that has been established within the inner lining of cell 10. Area 44 represents the area in the lining which is at a temperature above the solidus temperature of the bath, and which is therefore susceptible to liquid bath leakage after the establishment of the freeze-line barrier. Because area 44 is susceptible to such leakage, it tends to become quickly saturated with liquid bath.

Any liquid bath that had previously leaked into the lining beyond the location of the freeze-line barrier would freeze as soon as the barrier was established. Thus frozen, its advance toward shell 12 would be stopped, and therefore, the creation of a pathway for current leakage around the intermediate bipolar electrodes or to the shell would be inhibited. In addition, because area 44 of the cell lining is quickly saturated with liquid bath after the establishment of the barrier, further leakage into the lining by such liquid bath would be effectively stopped at the inner surface of the lining, in a short period of time, as the pores and interstices in the lining were filled with liquid bath. The establishment of the freeze-line barrier, and the subsequent saturation of the lining to the barrier with liquid bath also inhibits the encroachment of metal droplets into the refractory lining and thereby reduces deterioration of the refractory brick lining.

Thus, more advantageous cell operation may be achieved by the establishment of a freeze-line barrier 42 within the inner lining (composed of linings 32, 36, 38 and 40) of cell 10, when that cell is intended to be employed in the electrolytic reduction of a metal from the metal chloride. This barrier may be established, for example, by providing a bath having a concentration of sodium chloride high enough so that the bath solidus temperature is higher than the temperature of the inside surface of shell 12. The higher the concentration of sodium chloride, the higher will the solidus temperature be and the nearer to the inside surface of the lining will the freeze-line barrier be. Of course, as has been mentioned, the higher the concentration of sodium chloride during electrolysis the lower will the electrical efficiency of the cell be. Consequently, it has been found advantageous to place in the cell temporarily an initial bath of relatively high concentration of sodium chloride. A presently preferred initial bath composition contains at least 60% sodium chloride, by weight. After a freeze-line barrier is established in the cell lining and the lining is saturated to the barrier with initial bath, lithium chloride may be added to the initial bath to lower its sodium chloride concentration and create a more electrically efficient production bath. The addition of lithium chloride may accompany the replacement of the aluminum chloride consumed as electrolysis proceeds to produce aluminum metal. This addition of lithium chloride and aluminum chloride may be regulated as electrolysis proceeds so that the total bath volume is not substantially changed. Alternatively, the initial bath may be replaced entirely by a production bath. A presently preferred production bath composition contains at least 20% lithium chloride, by weight. Electrolysis is subsequently carried out in this production bath.

Although the preferred production bath has a solidus temperature below that of the preferred initial bath, the production bath does not easily penetrate into the cell lining after the establishment of the freeze-line barrier. This lining tends to remain saturated with initial bath, and consequently, there are few spaces in the lining that are available for occupation by the production bath. The initial bath continues to be inhibited from seeping further through the lining toward the shell by the presence of the freeze-line barrier at the location in the lining where the temperature is approximately equal to the solidus temperature of the initial bath. Although the production bath will dilute the initial bath by diffusion at locations of contact between the baths, this dilution proceeds slowly into the lining. A diluted solution of the two baths will eventually be established, however, at the location of the freeze-line barrier for the initial bath, thereby eroding this barrier and establishing a new such barrier for the dilute bath at a location somewhat closer to the shell.

Exemplary compositions of the various baths that have been successfully utilized are as follows. A cell such as the cell of LaCamera et al. was filled with an initial bath consisting essentially of 62.3% by weight sodium chloride, 30.4% by weight lithium chloride, 2.2% by weight magnesium chloride and 5.1% by weight aluminum chloride. A freeze-line barrier was established in the refractory lining, and the lining became saturated to the barrier with liquid initial bath. After about 24 hours, lithium chloride and aluminum chloride were added to replace the initial bath which saturated the lining and the aluminum chloride consumed during electrolysis. The resultant production bath consisted essentially of 59.2% by weight sodium chloride, 35.2% by weight lithium chloride, 1.6% by weight magnesium chloride and 4.0% by weight aluminum chloride. During operation of the cell thereafter, aluminum chloride was added incrementally to replace that consumed by electrolysis, but the composition of the production bath remained essentially as set forth above.

A second cell such as the cell of LaCamera et al. was filled with an initial bath consisting essentially of 65.2% by weight sodium chloride, 25.9% by weight lithium chloride, 5.0% by weight magnesium chloride and 3.9% by weight aluminum chloride. A freeze-line barrier was established in the refractory lining, and the lining became saturated to the barrier with liquid initial bath. After about 24 hours, lithium chloride and aluminum chloride were added to replace the initial bath which saturated the lining and the aluminum chloride consumed during electrolysis. The resultant production bath consisted essentially of 60.2% by weight sodium chloride, 29.1% by weight lithium chloride, 4.2% by weight magnesium chloride and 6.0% by weight aluminum chloride. During operation of the cell thereafter, aluminum chloride was added incrementally to replace that consumed by electrolysis, but the composition of the production bath remained essentially as set forth above.

In both of these examples of the operation of the method of this invention, the cells were able to operate during subsequent electrolysis with significantly reduced current losses. In addition, deterioration of the inner linings and corrosion damage to the shells during operation were also reduced.

It should be understood that the above description of the present invention is susceptible to various modifications, changes and adaptations, and the same are intended to be comprehended within the meaning and range of equivalents of the appended claims.

What is claimed is:

1. A method of preparing for operation a cell having an outer shell and an inner lining, which is employed to produce metal by electrolysis of a compound of the metal in a molten production bath, which comprises placing in the cell an initial bath, having a solidus temperature higher than the solidus temperature of the production bath and higher than the temperature of the inside surface of the shell, for the purpose of establishing a freeze-line barrier for the initial bath within the lining of the cell, and subsequently providing in the cell the production bath.

2. The method of claim 1, wherein the compound is the metal chloride, and wherein the production bath consists essentially of one or more halides of higher decomposition potential than the metal chloride.

3. The method of claim 2, wherein the initial bath contains at least 60% sodium chloride, by weight.

4. The method of claim 3, wherein the production bath contains at least 20% lithium chloride, by weight.

5. The method of claim 4, wherein the metal is aluminum.

* * * * *